US007410234B2

(12) United States Patent
Hara

(10) Patent No.: US 7,410,234 B2
(45) Date of Patent: Aug. 12, 2008

(54) INK-JET PRINTER AND INK JETTING METHOD

(75) Inventor: Koichiro Hara, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 11/638,921

(22) Filed: Dec. 14, 2006

(65) Prior Publication Data

US 2007/0132809 A1 Jun. 14, 2007

(30) Foreign Application Priority Data

Dec. 14, 2005 (JP) ..... 2005-360407

(51) Int. Cl.
*B41J 2/205* (2006.01)

(52) U.S. Cl. ..... 347/15; 347/43

(58) Field of Classification Search ..... 347/15, 347/43, 41, 19, 12
See application file for complete search history.

(56) References Cited

U.S. PATENT DOCUMENTS 6,084,604 A * 7/2000 Moriyama et al. ..... 347/15
2002/0163557 A1* 11/2002 Du et al. ..... 347/43
2005/0018012 A1* 1/2005 Iwasaki et al. ..... 347/43

FOREIGN PATENT DOCUMENTS

JP 3533771 3/1997

* cited by examiner

*Primary Examiner*—Lamson D. Nguyen
(74) *Attorney, Agent, or Firm*—Reed Smith LLP

(57) ABSTRACT

In an ink-jet head including black, yellow, magenta, cyan nozzle rows, the nozzle rows are arranged so that in each of the nozzle rows, adjacent nozzles are arranged by a predetermined spacing distance P, and that the black nozzle row is shifted in a nozzle-row alignment direction by a spacing distance smaller than the predetermined spacing distance P, with respect to the cyan, magenta and yellow nozzle rows. When a black dot is formed between monochrome-black dots adjacent in the sub-scanning direction, a dot of color-mixed black which is a mixture of the other three colors is formed between the monochrome-black dots. At this time, by adjusting a black-ink jetting amount to be greater than a total amount of the other three color inks, it is possible to make the monochrome-black dot and the color-mixed black dot to be mutually uniform in size.

13 Claims, 9 Drawing Sheets

| DOT SIZE | Bk | Y | M | C |
|---|---|---|---|---|
| LARGE | 24pl | 16pl | 16pl | 16pl |
| INTERMEDIATE | 7pl | 5pl | 5pl | 5pl |
| SMALL | 4pl | 3pl | 3pl | 3pl |

(pl: PICO LITER)

| DOT SIZE | Bk | Y | M | C |
|---|---|---|---|---|
| LARGE | 24pl | 16pl | 16pl | 16pl |
| INTERMEDIATE | 7pl | 5pl | 5pl | 5pl |
| SMALL | 4pl | 3pl | 3pl | 3pl |

(pl: PICO LITER)

INK-JET PRINTER AND INK JETTING METHOD

CROSS REFERENCE TO RELATED APPLICATION

The present application claims priority from Japanese Patent Application No. 2005-360407, filed on Dec. 14, 2005, the disclosure of which is incorporated herein by reference in its entirety.

BACKGROUND OF THE INVENTION

1. Field of the Invention

The present invention relates to an ink-jet printer which jets (discharges) ink onto a recording medium, particularly to an ink-jet printer capable of jetting yellow, magenta, and cyan inks, which are inks of three primary colors, and a black ink, and the present invention relates to an ink jetting method.

2. Description of the Related Art

Conventionally, as ink-jet printers, those of a type capable of performing color recording have been in wide use, and there has been known an ink-jet printer which jets not only a black ink but also yellow, magenta, and cyan inks which are inks of three primary colors independently onto a recording medium. It has been also known to utilize pseudo black color (sepia color; hereinafter referred to as color-mixed black) which is a mixture of a yellow ink, a magenta ink, and a cyan ink jetted onto a recording medium at an identical or same position thereof.

In Japanese Patent Publication No. 3533771, there is described a structure in which nozzle rows of (for) a black ink, a yellow ink, a magenta ink, and a cyan ink respectively are arranged in parallel to one another along a direction (sub-scanning direction) orthogonal to a scanning direction of an ink-jet head, with a predetermined nozzle-arranging spacing distance at which nozzles are arranged in each of the nozzle rows, and in which only the nozzle row for (associated with) the black ink is shifted (deviated), by ½ of the nozzle-arranging spacing distance, from the other nozzle rows in the sub-scanning direction. To form dots continuously in the sub-scanning direction by using only dots of the black ink (black-ink dots), the ink-jet head needs to run (perform scanning) twice in the scanning direction, with a recording medium shifted by ½ of the nozzle-arranging spacing distance. On the other hand, in the structure described in the above-described Japanese Patent Publication No. 3533771, by making the ink-jet head run only once in the scanning direction, a gap (space) between dots of the black ink (monochrome black) (monochrome-black-dots) which are adjacent in the sub-scanning direction can be filled with a dot of the color-mixed black (color-mixed black dot) which is a mixture of the yellow ink, the magenta ink, and the cyan ink. Therefore, it is possible to improve pixel density and increase recording speed in monochromatic recording.

However, the inventor has found out that in a case in which dots of the color-mixed black (color-mixed black dots) are thus recorded among monochrome-black dots, the dots are nonuniformly formed. Such nonuniformity of the dots adversely affects printing quality.

SUMMARY OF THE INVENTION

The present invention solves the above problems, and an object of the present invention is to improve uniformity of dots formed on a recording medium so as to obtain satisfactory recording quality, in recording which uses color-mixed black obtained by jetting and mixing a yellow ink, a magenta ink, and a cyan ink. It should be noted that parenthesized reference numerals and symbols assigned to elements shown below are merely examples of the elements and are not intended to limit the elements.

According to a first aspect of the present invention, there is provided an ink-jet printer (1) which performs recording on a recording medium (PA) by jetting a black ink (Bk), a yellow ink (Y), a magenta ink (M), and a cyan ink (C), the ink-jet printer (1) including:

an ink-jet head (3) including black, cyan, magenta and yellow nozzle rows (15*a* to 15*d*) each of which is formed of a plurality of nozzles (15) arranged in a predetermined direction, and which are aligned in a direction orthogonal to the predetermined direction; and a controller (30) which controls the ink-jet head (3);

wherein adjacent nozzles (15), among the nozzles (15) in each of the nozzle rows (15*a* to 15*d*) are arranged at a predetermined spacing distance P;

the black nozzle row (15*a*) is shifted, in the predetermined direction by a spacing distance ΔP smaller than the predetermined spacing distance P, from the cyan, magenta and yellow nozzle rows (15*b* to 15*d*), respectively;

when a black dot is formed between monochrome-black dots (A1) of monochrome black which are adjacent to each other in the predetermined direction and which are formed by jetting the black ink (Bk), the controller (30) controls the ink-jet head (3) so that the yellow ink (Y), the magenta ink (M), and the cyan ink (C) are jetted from nozzles (15) to form a color-mixed black dot (B1) of color-mixed black which is a mixture of the yellow ink (Y), the magenta ink (M), and the cyan ink (C); and the controller (30) controls the ink-jet head (3) so that an amount of the black ink (Bk) which is jetted to form one dot of the monochrome-black dots (A1) is greater than a total amount of the yellow ink (Y), the magenta ink (M), and the cyan ink (C) jetted to form the color-mixed black dot (B1).

In a case in which the color-mixed black dot or dots (B1) are recorded among the monochrome-black dots (A1) in a mixed manner, if the amounts of the inks jetted from the nozzles (15) jetting the four color inks respectively are set equal to one another, an ink amount (volume) for the color-mixed black dot (B1) which is a mixture of the three color inks (Y, M, C) jetted from the three nozzles (15) respectively becomes greater than an ink amount for (per) the monochrome black-dot (A1). Further, in a case in which a pigment ink is used as the black ink (Bk) and dye inks are used as the three color inks (Y, M, C) other than the black ink (Bk), in order to increase sharpness of black in character recording and the like and to make color vivid, the monochrome-black dot (A1) and the color-mixed black dots (B1) become non-uniform in size because a dot of the pigment ink, which hardly blur, is formed as a dot which is smaller on the recording medium (PA) than a dot of the dye ink even if the pigment ink and the dye ink are jetted in a same amount (volume). With respect to this situation, the inventor has found out that it is possible to improve the recording quality by making the dots formed on the recording medium (PA) uniform in size. According to the present invention, the amount of the black ink (Bk) jetted to form one monochrome-black dot (A1) is made greater than the total amount of the yellow ink (Y), the magenta ink (M), and the cyan ink (C) jetted to form one color-mixed black dot (B1). Accordingly, in a case in which the color-mixed black dots (B1) and the monochrome-black dots (A1) both exist in a mixed manner, it is possible to make the dots uniform in size on the recording medium (PA). Further, whereas the adjacent nozzles (15) in each of the nozzle rows (15*b* to 15*d*), which are different from the nozzle row (15*a*) for the black ink, are arranged in the predetermined direction at the predetermined spacing distance P, only the black nozzle row (15*a*) for the black ink (Bk) is shifted from the other nozzle rows (15*b* to 15*d*) in the predetermined direction by the spacing distance ΔP which is smaller than the predetermined spacing distance P. Therefore, when the ink-jet head (3) is made to run once with respect to the recording medium (PA) in the direction orthogonal to the predetermined direction, it is possible to form the color-mixed black dot (B1) by jetting the yellow ink (Y), the magenta ink (M), and the cyan ink (C) between the monochrome-black dots (A1), which are adjacent in the predetermined direction, as necessary, thereby making it possible to improve the pixel density.

In the ink-jet printer (1) of the present invention, the black nozzle row (15*a*) may be shifted, in the predetermined direction by ½ of the predetermined spacing distance P, from the cyan, magenta and yellow nozzle rows (15*b* to 15*d*), respectively. In this case, by making a carriage (9) run only once in the scanning direction, it is possible to form a color-mixed black dot (B1) at a position between monochrome-black dots (A1) adjacent in the predetermined direction so that the monochrome-black dots (A1) and the color-mixed black dot (B1) are made to be continuous in the predetermined direction, which consequently can improve the recording speed.

In the ink-jet printer (1) of the present invention, the nozzles (15) which form the black nozzle row (15*a*) and which jets the black ink (Bk) may have an opening which is greater in size than that of the nozzles (15) which form the cyan, magenta and yellow nozzle rows (15*b* to 15*d*) and which jet the cyan ink (C), the magenta ink (M), and the yellow ink (Y) respectively. In this case, an amount of the black ink (Bk) jetted from each of the nozzles (15) for the black ink (Bk) can be made greater than an amount in which each of the yellow ink (Y), the magenta ink (M), and the cyan ink (C) is jetted from the nozzles (15) for these inks, respectively. Therefore, in a case in which the color-mixed black dots (B1) and the monochrome-black dots (A1) both exit in a mixed manner, it is possible to make the dots uniform in size on the recording medium (PA).

In the ink-jet printer (1) of the present invention, when the color-mixed black dot (B1) is formed between the monochrome-black dots (A1), an amount of the yellow ink (Y), an amount of the magenta ink (M), and an amount of the cyan ink (C) jetted to form the color-mixed black dot (B1) may each be adjusted to be smaller than the amount of the black ink (Bk) jetted to form one dot of the monochrome-black dots (A1). In this case, the color-mixed black dot (B1) and the monochrome-black dot (A1) which are formed on the recording medium (PA) can be formed in a substantially equal area size or dimension, thereby making it possible to improve the recording quality. Furthermore, since each of the amount of the yellow ink (Y), the amount of the magenta ink (M), and the amount of the cyan ink (C) jetted to form the color-mixed black dot (B1) is reduced, electrical driving power applied to a piezoelectric actuator (17) can be reduced and thus the heat generation of the piezoelectric actuator (17) can also be reduced.

In the ink-jet printer (1) of the present invention, an ink, which blurs more easily with respect to the recording medium (PA) than the black ink (Bk), may be selected in advance as each of the yellow ink (Y), the magenta ink (M), and the cyan ink (C). As a result, the color-mixed black dot (B1) which easily blurs and the monochrome-black dot (A1) which blurs in an extent smaller than the color-mixed black dot (B1) can be made uniform in size, thereby making it possible to realize satisfactory recording quality.

In the ink-jet printer (1) of the present invention, the amount of the black ink (Bk) jetted to form one dot of the monochrome-black dots (A1) may be 1.3 to 1.5 times an amount of each of the yellow, magenta, and cyan inks (Y, M, C) jetted to form one dot of each of the yellow, magenta, and cyan inks in a size same as that of one dot of the monochrome-black dots (A1). Generally, a pigment ink is used as the black ink (Bk) and dye inks are used as the color inks (Y, M, C) in many cases, and since the pigment ink blurs to a smaller extent as compared to the dye ink. Accordingly, by jetting the black ink (Bk) in an amount greater than an amount of each of the color inks (Y, M, C), it is possible to make the black dot (A1) and the dot of each of the colors uniform in size.

In the ink-jet printer (1) of the present invention, when the color-mixed black dot (B1) is formed between the monochrome-black dots (A1), the amount of the black ink (Bk) jetted to form one dot of the monochrome-black dots (A1) may be smaller than a maximum ink amount jettable for forming one dot of the monochrome-black dots (A1) from each of the nozzles (15) which form the black nozzle row (15*a*) and which jet the black ink (Bk). By using the color-mixed black dot (B1), it is possible to form, on the recording medium (PA), a black-color region (black-color area) which is continuous at least in the sub-scanning direction without jetting the ink droplets each in the maximum ink amount jettable from each of the nozzles (15) for the black ink (Bk). To jet the ink droplet in the maximum ink amount, electrical driving power applied to the piezoelectric actuator (17) also becomes high. However, by adjusting the ink amount, in which the black ink is to be jetted, to an amount smaller than the maximum ink volume, it is possible to reduce the electrical power, and to reduce heat generation of the piezoelectric actuator (17) as well.

According to a second aspect of the present invention, there is provided an ink jetting method for jetting a black ink (Bk), a yellow ink (Y), a magenta ink (M), and a cyan ink (C), the method including:

preparing an ink-jet head (3) which includes black, cyan, magenta and yellow nozzle rows (15*a* to 15*d*) each formed of a plurality of nozzles (15) arranged in a predetermined direction at a predetermined spacing distance P, and are aligned in a direction orthogonal to the predetermined direction, and in which the black nozzle row (15*a*) is shifted in the predetermined direction by a spacing distance ΔP smaller than the predetermined spacing distance P, from the cyan, magenta and yellow nozzle rows (15*b* to 15*d*), respectively;

jetting the yellow ink, the magenta ink, the cyan ink concurrently so as to form a color-mixed black dot (B1) of color-mixed black which is a mixture of the yellow ink (Y), the magenta ink (M), and the cyan ink (C), when a black dot is formed between monochrome-black dots (A1) of monochrome black which are adjacent to each other in the predetermined direction and which are formed by jetting the black ink (Bk); and adjusting an amount of the black ink (Bk) to be greater than a total amount of the yellow ink (Y), the magenta ink (M), and the cyan ink (C) jetted for forming the color-mixed black dot (B1), when one dot of the monochrome-black dots (A1) is formed.

According to this method, the amount of the black ink (Bk) to be jetted is made greater than the total amount of the color inks (yellow, magenta and cyan inks) for forming the color-mixed black dot (B1). Accordingly, in a case in which the color-mixed black dots (B1) and the monochrome-black dots (A1) both exit in a mixed manner, it is possible to make the dots on the recording medium (PA) uniform in size. Further, whereas the adjacent nozzles (15), in each of the nozzle rows (15*b* to 15*d*) for one of the color inks other than the black ink, are arranged in the sub-scanning direction at the predetermined spacing distance P, only the black nozzle row (15*a*) for the black ink (Bk) is shifted, from the nozzle rows (15*b* to 15*d*), in the sub-scanning direction by the spacing distance Δp which is smaller than the predetermined spacing distance P. Therefore, when the ink-jet head (3) is made to run once in the scanning direction with respect to the recording medium (PA), it is possible to form a color-mixed black dot (B1) by jetting the yellow ink (Y), the magenta ink (M), and the cyan ink (C) between the monochrome-black dots (A1) adjacent in the sub-scanning direction, as necessary, thereby making it possible to improve the pixel density.

DETAILED DESCRIPTION OF THE PREFERRED EMBODIMENTS

In the following, basic embodiments of the present invention will be explained based on the drawings.

Figure 1:
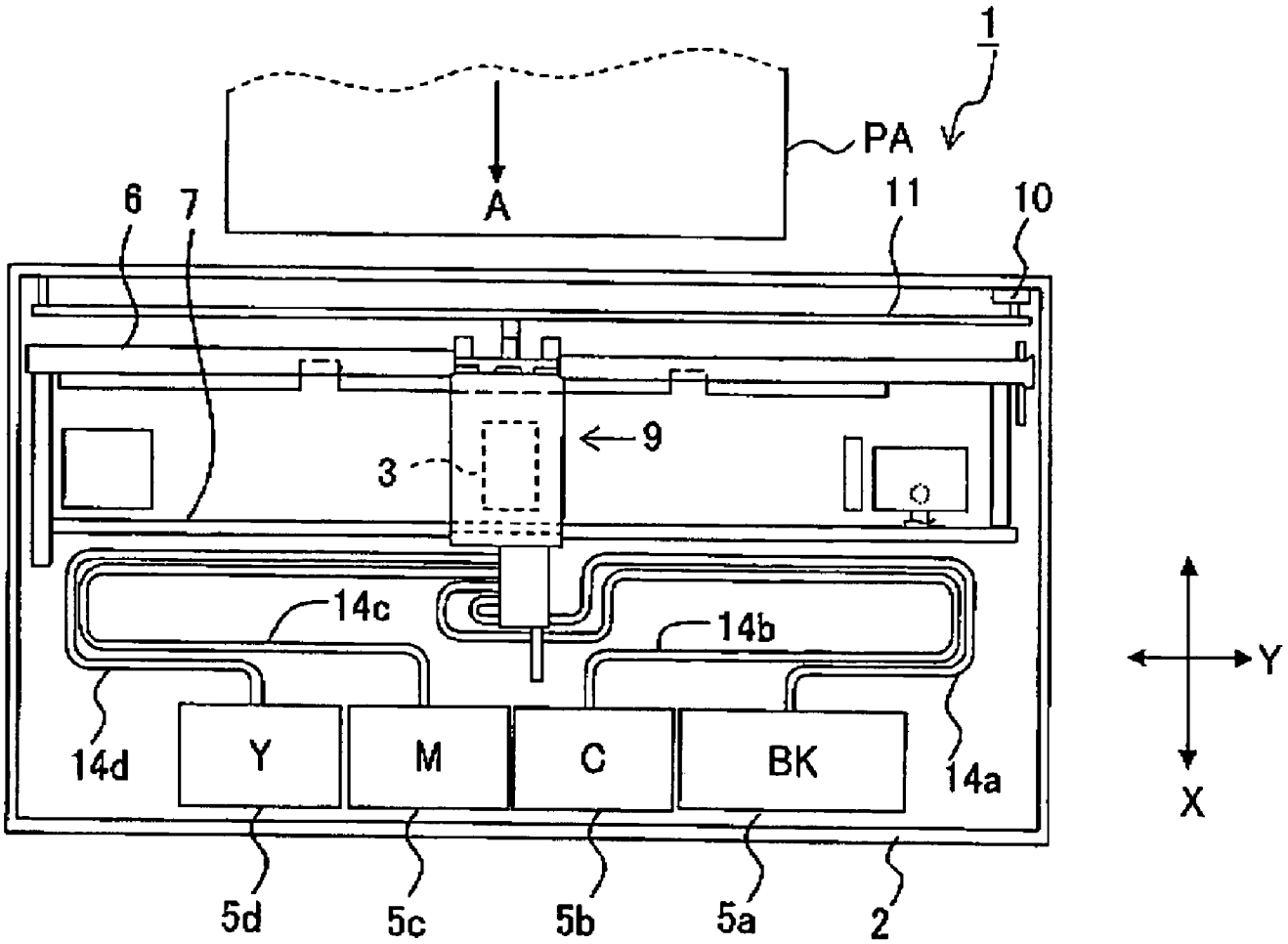
FIG. 1 is a plan view of main parts or components of an ink-jet printer.

An ink-jet printer 1, as shown in FIG. 1, of this embodiment (first embodiment) is applicable, for example, not only to a printer device having only a printer function but also to a Multi Function Device (MFD) including, in addition to the printer function, a copy function, a scanner functions a facsimile function, and so on. The ink-jet printer 1 has an ink-jet head 3 and a carriage 9. The ink-jet head 3 is provided in a body frame 2 of the ink-jet printer 1 and mounted on the carriage 9 so as to perform recording by jetting an ink to a paper PA as a recording medium, and the ink-jet head 3 is constructed to be movable along a main scanning direction (Y direction).

The carriage 9 is slidably arranged on a rear guide shaft 6 and a front guide shaft 7 which are provided on the body frame 2 in parallel to each other along the Y direction. The carriage 9 is reciprocatable in the main scanning direction (Y direction) along the front and rear guide shafts 6, 7 by a carriage motor 10 which is arranged in the body frame 2 on the right rear side thereof and by a timing belt 11 which is an endless belt. The paper PA is transported or fed, by a known paper transporting mechanism (not shown), in a horizontal manner across a space below or under the lower side of the ink-jet head 3, along a sub-scanning direction (X direction) which is orthogonal to the main scanning direction (direction indicated by an arrow A in FIG. 1. To perform a recording, the ink is jetted onto the paper PA from nozzles 15 (see FIG. 3) of the ink-jet head 3 which is attached to the carriage 9 and moves in the main scanning direction (Y direction).

Figure 9:
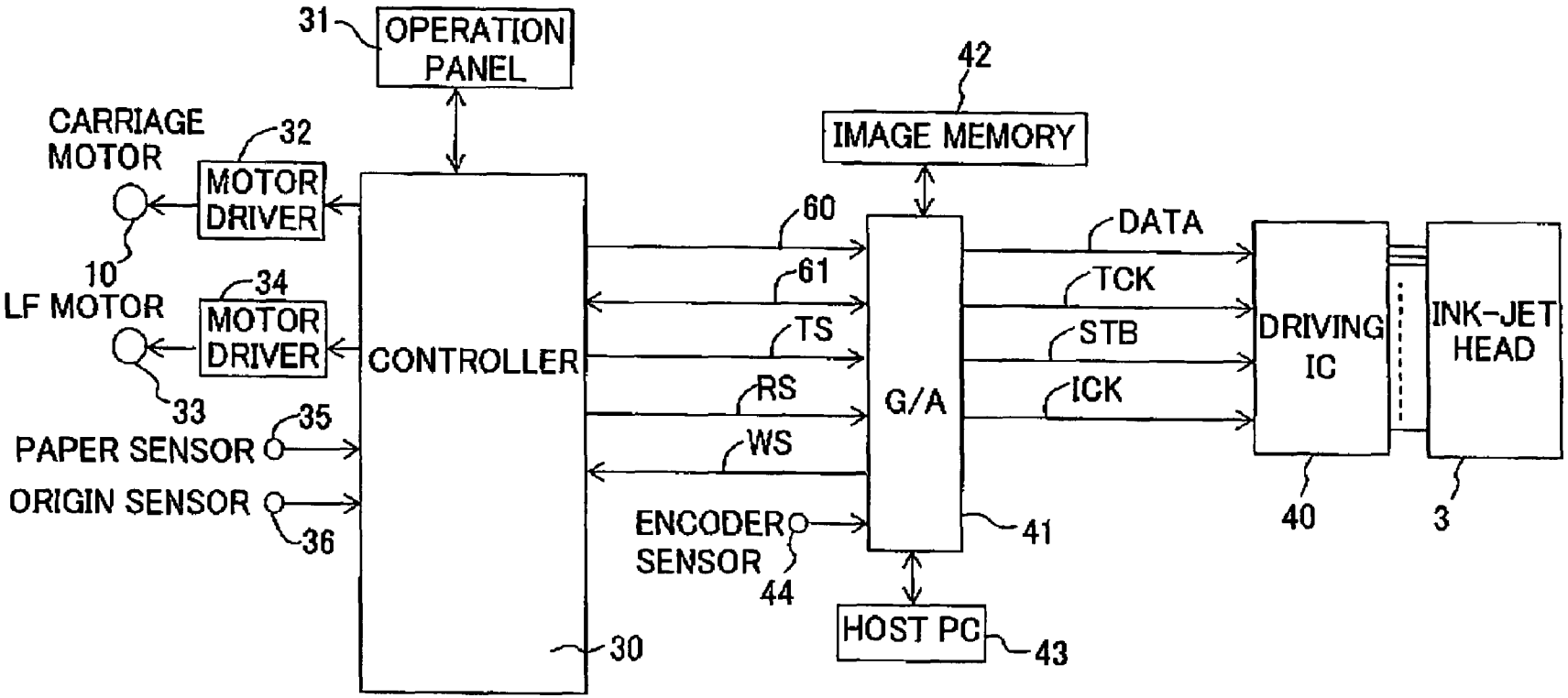
FIG. 9 is a block diagram showing a major structure of a control system of the ink-jet printer.

As shown in FIG. 9, the ink-jet printer 1 is provided with a controller 30 which controls the scanning performed by the ink-jet head 3, the feeding of the paper PA in the sub-scanning direction, and the jetting of the ink from each of the nozzles 15. An operation panel 31 through which a user gives an instruction for a recording mode and the like; a motor driver 32 for driving the carriage motor 10; a motor driver 34 for driving an LF motor 33; a paper sensor 35 which detects a leading end of the paper PA; and an origin sensor 36 which detects an origin position of the carriage 9 are connected to the controller 30. The controller 30 controls the ink-jet head 3 to adjust a jetting amount of the ink jetted from each of the nozzles 15. For this purpose, a plurality of kinds of driving waveforms of driving voltages, applied to a piezoelectric actuator 17, are prepared in the controller 30 according to ink jetting amounts.

The ink-jet head 3 is driven by a driving IC 40, and the driving IC 40 is controlled by a gate array (G/A) 41. Electrodes constructing piezoelectric elements, respectively, provided in the ink-jet head 3 are connected to the driving IC 40, and based on the control by the gate array 41, the driving IC 40 generates a driving signal suitable for the ink-jet head 3 to apply the generated driving signal to each of the electrodes.

The controller 30 and the gate array 41 are connected to each other via an address bus 60 and a data bus 61. The controller 30 generates a recording timing signal TS and a control signal RS according to a program pre-stored in the controller 30, and transfers or transmits the signals TS, RS to the gate array 41. In accordance with the recording timing signal TS and the control signal RS and based on recording data stored in an image memory 42, the gate array 41 generates transfer data signal DATA for recording the recording data onto the paper PA, a transfer clock TCK which is synchronized with the transfer data signal DATA, a strobe signal STB, and a recording clock ICK, and the gate array 41 transmits these signals DATA, TCK, STB, ICK to the driving IC 40.

Further, the gate array 41 makes the image memory 42 store therein recording data transmitted from an external apparatus such as a host computer (host PC) 43. Based on the data transmitted from the host computer 43 or the like, the gate array 41 generates a data reception/interruption signal WS and transmits the generated signal WS to the controller 30. Further, an encoder sensor 44, which detects a running position of the carriage 9, is connected to the gate array 41.

Note that an ink jetting operation from the nozzles 15 is performed, as generally known, such that while the carriage 9 is moving in the main scanning direction (Y direction) at a constant speed in a state where the paper PA is stopped; after the scanning is performed once (one time), the paper PA is fed or transported in the sub-scanning direction by a predetermined feed amount; and then the next scanning is performed in a similar manner.

In the body frame 2, an ink tank 5*a* storing a black ink (Bk), an ink tank 5*b* storing a cyan ink (C), an ink tank 5*c* storing a magenta ink (M), and an ink tank 5*d* storing a yellow ink (Y) are stationary placed, and the inks in the ink tanks are supplied to the ink-jet head 3 via flexible ink supply tubes 14*a* to 14*d* respectively.

Figure 2:
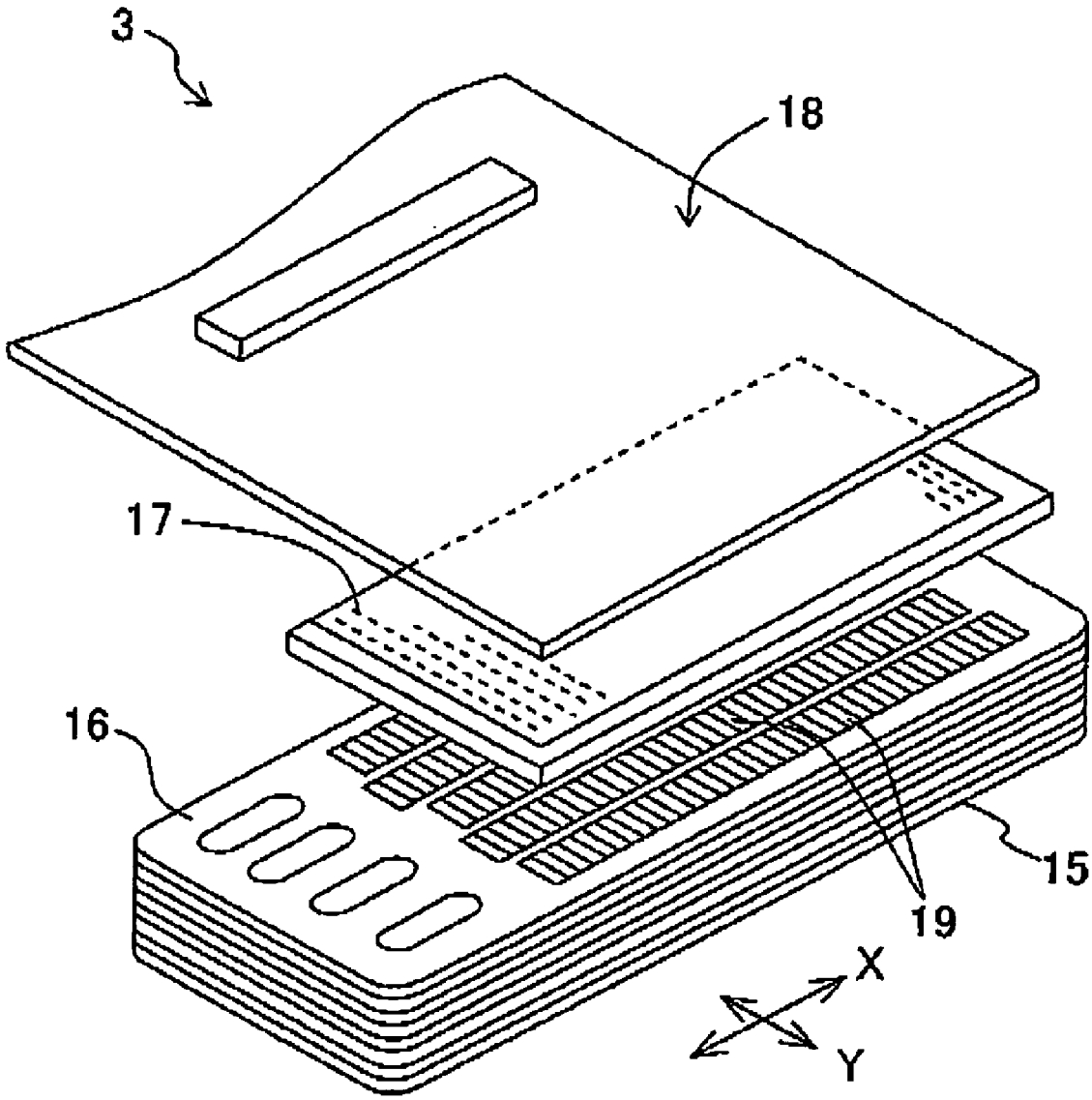
FIG. 2 is an exploded perspective view of an ink-jet head.

The ink-jet head 3 is attached to the carriage 9 so that the nozzles 15 (see FIG. 3) are open and exposed on the side of the lower surface of the carriage 9. As shown in FIG. 2, the ink-jet head 3 is constructed of a cavity unit 16 which includes the plurality of nozzles 15 and ink channels 19 corresponding to the nozzles 15 respectively; the piezoelectric actuator 17 which applies a jetting pressure to the inks in the ink channels 19; and a flexible flat cable 18 for applying an electric signal to the piezoelectric actuator 17.

Figure 3:
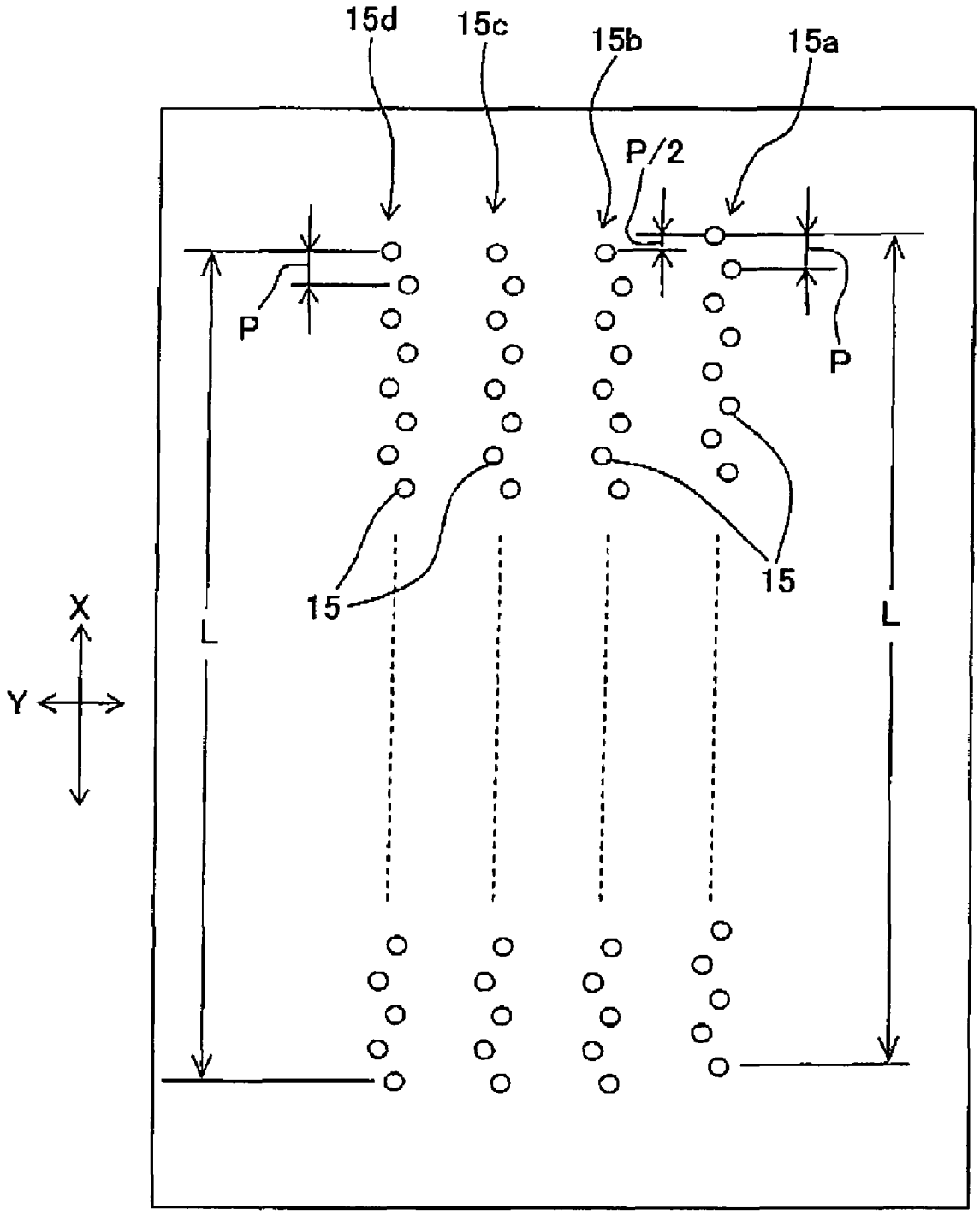
FIG. 3 is a view showing a nozzle arrangement in a first embodiment.

As shown in FIG. 3, the nozzles 15, each of which jets one color ink among the black, cyan, magenta, and yellow inks, are arranged in rows in the sub-scanning direction (predetermined direction: X direction) to form nozzle rows, and the nozzle rows are aligned in the main scanning direction (direction orthogonal to the predetermined direction: Y direction) corresponding to the colors of the inks, respectively, such that at least one nozzle row, among the nozzle rows, for one of the black, cyan, magenta and yellow inks. In this embodiment, a nozzle row 15*a* of the black ink (black nozzle row 15*a*), a nozzle row 15*b* of the cyan ink (cyan nozzle row 15*b*), a nozzle row 15*c* of the magenta ink (magenta nozzle row 15*c*), and a nozzle row 15*d* of the yellow ink (yellow nozzle row 15*d*) are arranged in the main scanning direction (Y direction) such that these four nozzle rows correspond to the four colors respectively. In each of the nozzle rows corresponding to one of the colors, the nozzles 15 are arranged in a zigzag or staggered form; and in each of the nozzle rows, nozzles 15 among the nozzle rows 15 which are adjacent in the sub-scanning direction (X direction) are arranged at a predetermined spacing distance P In each of the nozzle rows, nozzles 15, among the nozzles 15, positioned at both ends thereof respectively is arranged at a spacing distance "L". Further, the predetermined spacing distance P corresponds to a recording resolution Ndpi (dot per inch, N is a positive integer) in the sub-scanning direction (X direction).

In this embodiment, the black nozzle row 15*a* is shifted, from the cyan nozzle row 15*b*, the magenta nozzle row 15*c*, and the yellow nozzle row 15*d*, in the sub-scanning direction (X direction) by an amount corresponding to ½ (half) of the predetermined spacing distance P. In each of the cyan nozzle row 15*b*, the magenta nozzle row 15*c*, and the yellow nozzle row 15*d* are aligned in the main scanning direction (Y direction), the nozzles 15 are arranged along a straight line. Therefore, in a case in which the resolution in the sub-scanning direction (X direction) of the nozzles 15 in each of the nozzle rows is Ndpi (N is a positive integer), then the nozzles 15 of the black ink and the nozzles 15 of the color inks other than the black ink are arranged so that the resolution in the sub-scanning direction therebetween is 2 Ndpi. Here, as an example, it is assumed that the resolution in the sub-scanning direction is 150 dpi in each of the nozzle rows corresponding to the colors respectively, then the resolution in the sub-scanning direction between the nozzles 15 of the black ink and the nozzles 15 of the other color inks is 300 dpi.

With respect to the nozzles 15 of the respective colors, an opening size (orifice size) of the nozzles 15 of the black ink is set to be greater in advance than that of the nozzles 15 of the other three colors, and the opening size of the nozzles 15 of the black ink may be 20.5±1 μm, and the opening size of the nozzles 15 of the other three colors may be 17.0±1 μm. Note that in this embodiment, whereas the opening size of the nozzles 15 of the black ink is set to be 20.5 μm, the opening size of the nozzles 15 of the other three colors is set to be 17.0 μm. The opening size of the nozzles 15 of the other three color inks (X, M, C) is set to be smaller than the opening size of the nozzles 15 of the black ink. Consequently, when the nozzles 15 for the black ink and the nozzles 15 for the other three colors are driven by the piezoelectric actuator 17 in a same manner, each of the nozzles 15 of the other three colors can jet an ink droplet in an amount smaller than an amount in which an ink droplet jetted from the nozzles 15 of the black ink.

Figures 4, 5:
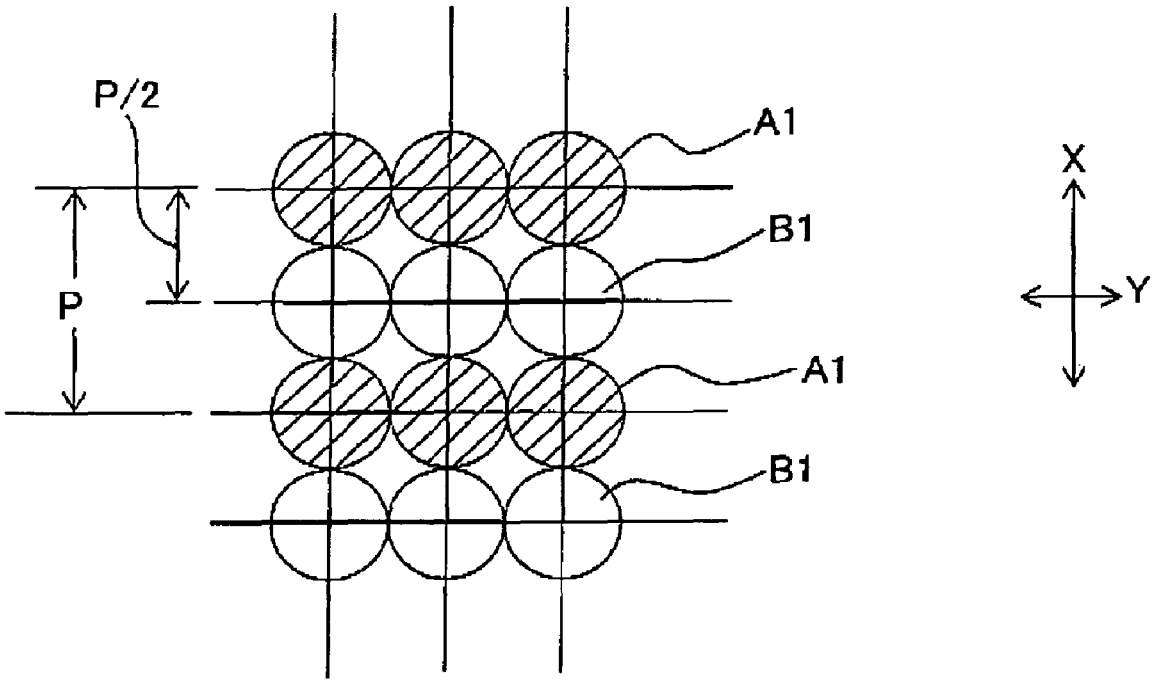
FIG. 4 is a view explaining a recording state in the first embodiment in a partial manner.
FIG. 5 is table showing an example of ink jetting amounts for forming dots mutually different in size.

An ink jetting amount per dot jetted from each of the nozzles 15 is adjustable by controlling a driving manner of the piezoelectric actuator 17 as publicly known. Therefore, a plurality of kinds of driving waveforms are prepared in advance in the controller 30 in order to jet a plurality of ink droplets which are mutually different in ink jetting amount, and based on data to be recorded, the controller 30 selects an optimum driving waveform, among the driving waveforms, to be applied to an active portion, of the piezoelectric actuator 17, corresponding to each of the nozzles 15. FIG. 5 shows, as an example, ink jetting amounts to form dots which are different in size, and three kinds of ink dot sizes referred to as large, intermediate, and small are prepared for the nozzles 15 of the black ink and for the nozzles 15 of the other three color inks (Y, M, C). To form a large dot of black (large-black dot), the black ink is jetted in an amount of 24 pl, whereas an amount in which the yellow ink is jetted to form a large dot of yellow (large-yellow dot), an amount in which a magenta ink is jetted to form a large dot of magenta (large-magenta dot), and an amount in which the cyan ink is jetted to form a large dot of cyan (large-cyan dot) are adjusted to be 16 pl, respectively. Further, to form the intermediate dot, the black ink is jetted in an amount of 7 pl, whereas an amount in which the yellow ink is jetted, an amount in which the magenta ink is jetted, and an amount in which the cyan ink is jetted are 5 pl, respectively. To form the small dot, an amount in which the black ink is jetted is 4 pl, whereas an amount in which the yellow ink is jetted, an amount in which the magenta ink is jetted, and an amount in which the cyan ink is jetted are 3 pl, respectively. Generally, a pigment ink is used as the black ink and dye inks are used as the color inks in many cases. Since the pigment ink blurs to an extent smaller as compared to the dye ink, an amount in which the black ink is jetted to form one dot (one black dot) is adjusted 1.3 to 1.5 times the amount in which each of the color inks is jetted to form one dot of the yellow, magenta and cyan with the same size as the one dot of the black ink. Although not shown in FIG. 5, it is also possible to form an extra-large dot by jetting the ink in an amount greater than the amount for forming a large dot.

Next, a recording operation performed by the ink-jet printer 1 as structured above will be explained by using FIG. 4 showing a recording state in a partially manner. In FIG. 4, dots of monochrome black (monochrome-black dots) by the black ink are indicated as "A1"; and dots of color-mixed black (color-mixed black dots) which is a mixture of the yellow ink, the magenta ink, and the cyan ink jetted to the same position of the recording medium PA are indicated as "B1". In the ink-jet printer 1, when black dots are to be further formed between the monochrome-black dots A1 which are adjacent to each other in the sub-scanning direction (X direction) and which are formed by jetting the black ink, then the controller 30 drives the ink-jet head 3 via the driving IC 40 so that the yellow ink, the magenta ink, and the cyan ink are jetted, thereby forming the color-mixed black dots B1 each of which is a mixture of the yellow ink, the magenta ink, and the cyan ink.

Namely, in the ink-jet printer 1, in a case in which data to be recorded includes a solid black area which is continuous at least in the sub-scanning direction or in a case in which black dots need to be formed with 2 Ndpi (300 dpi) resolution in the sub-scanning direction, then the timing at which the inks are jetted from the nozzles 15 (jetting timing of the nozzles 15) is controlled so that the color-mixed black dots B1 are formed, between the monochrome-black dots A1 which are adjacent in the sub-scanning direction (X direction), by making the ink-jet head perform one running (one pass) in the main scanning direction (Y direction). Note that although FIG. 4 shows each one of the dots with a small area dimension in order to clearly show the arrangement of the dots, but in an actual printing, each of the dots has an area dimension to an extent such that adjacent dots overlap with each other without any space (gap) existing therebetween.

Consequently, only by making the ink-jet head 3 perform only one running in the main scanning direction (Y direction), it is possible to form, with 2 Ndpi (300 dpi) resolution, a black area continuous in the sub-scanning direction. Of course, in order to form the black area continuous also in the main scanning direction (Y direction), it is allowable that the inks are jetted (jetted at continuous driving cycles) so that monochrome-black dots A1 and color-mixed black dots B1 are both continuously formed in the main scanning direction (Y direction). Further, in order to form the black area still longer in the sub-scanning direction, then it is allowable to perform an operation in which, after the paper PA is fed in the sub-scanning direction (X direction) by a length L+P, the ink-jet head 3 is made to run in the main scanning direction (Y direction) to perform the jetting similar to the above.

To realize 2 Ndpi (300 dpi) resolution in the sub-scanning direction by using only the monochrome-black dots A1, then after the ink-jet head 3 is made to run once in the main scanning direction (Y direction), it is necessary to feed the paper PA in the sub-scanning direction (X direction) by an amount corresponding to P/2 and to further make the ink-jet head 3 run once more (to perform bi-directional recording or perform uni-directional recording twice in the main scanning direction). As compared with this case, in a case in which gaps (spaces) between the monochrome-black dots A1 are filled by using the color-mixed black dots B1, the 2 Ndpi (300 dpi) resolution in the sub-scanning direction can be realized by one running, thereby making it possible to reduce the recording time, and consequently realizing a high-speed recording.

Further, a method is also conceivable in which the monochrome-black dots A1 are formed by using ink droplets formed in a maximum ink amount jettable from the nozzles 15 of the black ink (extra-large droplets), thereby forming a black area continuous in the sub-scanning direction with only these monochrome-black dots A1 having the extra large size. In this case, the resolution in the sub-scanning direction becomes Ndpi (150 dpi), and in some case, a white streak is generated in the black area due to lack of an amount of the ink droplets even if the extra-large droplets are used. In this embodiment, the gaps between the monochrome-black dots A1 are filled by using the color-mixed black dots B1, a continuous black area is formed while an amount in which the black ink is jetted to form one dot of the monochrome black is adjusted to an amount smaller than the maximum ink amount per one dot jettable from each of the nozzles 15 of the black ink. By adjusting the ink amount to be smaller than the maximum ink amount for the nozzles of the black ink, it is possible to reduce electrical power and also to reduce heating of the piezoelectric actuator 17.

Further, by making an amount of the black ink jetted to form one dot of the monochrome black to be greater than the total amount of the yellow ink, the magenta ink, and the cyan ink jetted to form one dot of the color-mixed black, it is possible to make the monochrome-black dots and the color-mixed black dots to be uniform in size, thereby obtaining satisfactory recording quality. At this time, an ink amount of each of the yellow ink, the magenta ink, and the cyan ink is adjusted to an amount smaller than the ink amount of the black ink. In this embodiment, the opening size of the nozzles 15 of the yellow ink, the magenta ink, and the cyan ink is set smaller than the opening size of the nozzles 15 of the black ink. Accordingly, each of the nozzles 15 of these three color inks easily jets an ink droplet in a smaller amount than an amount of the black ink jetted to form an ink droplet of the black ink.

Consequently, even when the color-mixed black dots B1 are formed among the monochrome-black dots A1 in a mixed manner, it is possible to prevent the dots from becoming nonuniform in size due to the spreading (blurring) of the color-mixed black dot B1 on the recording medium PA. Accordingly, this improves the recording quality. Further, for the purpose of forming the dots of the color-mixed black, the inks are jetted onto the recording medium in amount just required for forming the black area, but not jetted in an amount unnecessarily greater than the required amount. As a result, it is also possible to prevent excessive (unnecessary) consumption of the inks.

In order to form the color-mixed black dots, small ink droplets having a smaller size such as the intermediate droplets and the like are used with respect to the yellow, magenta, and cyan inks. Then it is possible to obtain an effect of reducing the electrical driving power applied to the piezoelectric actuator 17 to cause the jetting of these droplets, and an effect of also reducing a heat generation amount of the piezoelectric actuator 17. Of course, the yellow ink, the magenta ink, and the cyan ink are used not only to form color-mixed black dots but also to form color dots, and in the formation of the color dots, large ink droplets such as the large droplets are selected according to data to be recorded.

Further, in general, whereas a pigment ink is often used as the black ink, dye inks are often used as the color inks such as the yellow ink, the magenta ink, and the cyan ink. Therefore, the yellow, magenta, and cyan color inks easily blur on the recording medium to a great extent as compared with the black ink does, and thus a dot diameter of each of these color inks on the recording medium becomes larger than that of the black ink dot even if the color ink droplets and the black ink droplet are same in ink-droplet volume. Therefore, in consideration of an extent at which the color inks blur, the nozzles 15 of the black ink are formed to be greater than the nozzles 15 of the other three color inks, as described above, so that each of the nozzles 15 of the color inks jets an ink droplet in an amount smaller than that of the black-ink droplet even if each of the black nozzles and three color nozzles are driven by the piezoelectric actuator 17 in the same manner.

Note that the above-described color-mixed black dot is used not only in a case in which monochrome recording is instructed to the controller 30 (monochrome mode) but also in a case in which color recording is instructed (color mode) to the controller 30. In the latter case, the yellow ink, the magenta ink, and the cyan ink are jetted both to a color area and a black area as required.

Figure 6A:
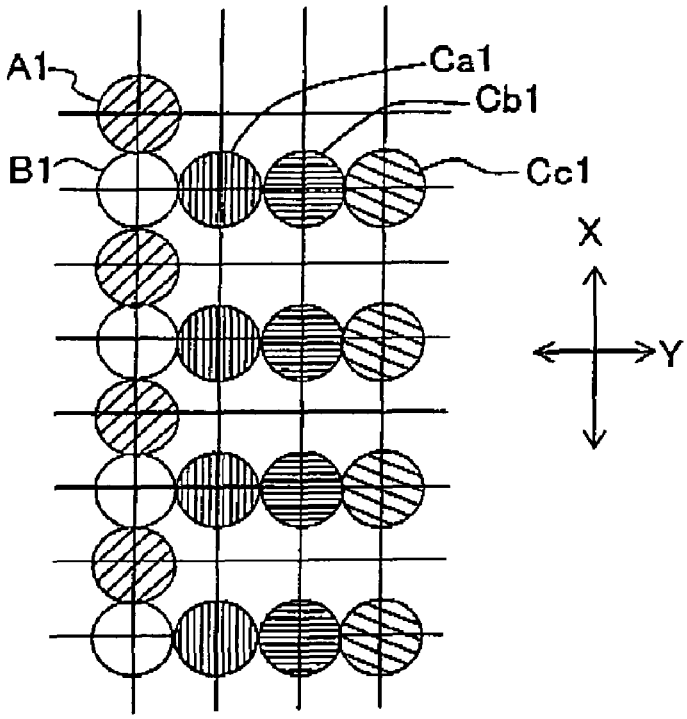
FIG. 6A and FIG. 6B are views explaining another recording state in the first embodiment in a partial manner.
Figure 6B:
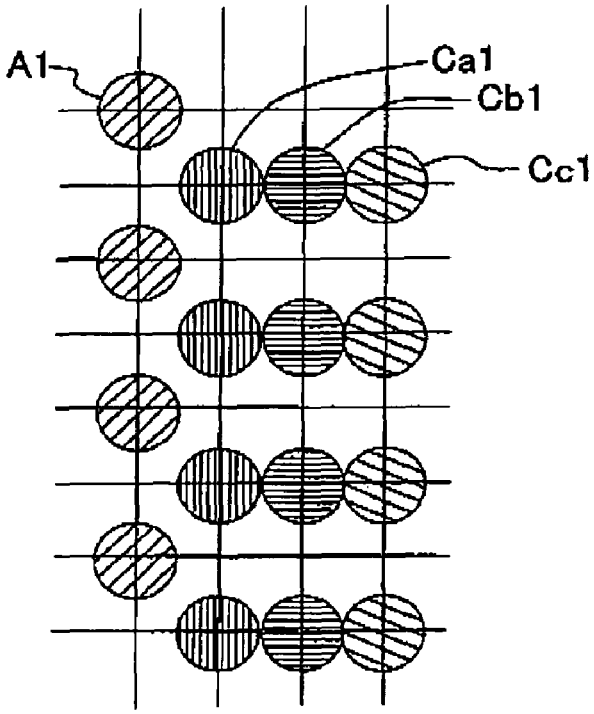

FIGS. 6A and 6B show examples of recording states in each of which an ink consumption amount is saved in the color mode. In FIG. 6A, to form the black dots continuously in the sub-scanning direction at each timing in the main scanning direction (Y direction) of a matrix in which the dots are arranged, the monochrome-black dots A1 and the color-mixed black dots B1 are formed adjacently in the sub-scanning direction as described above. Further, dots Ca1, Cb1, Cc1, each formed by single color or formed by a mixture of two colors among the other three colors, are formed at each timing at positions shifted in the sub-scanning direction by P/2 from the positions at each of which one of the monochrome-black dots A1 is formed. In this case, a black portion, for example, a character, in a recorded image is recorded more clearly than in a case shown in FIG. 6B which will be described next.

FIG. 6B shows a recording state in which an ink consumption amount is saved further than that in the case shown in FIG. 6A. In this case, even when the black dots are to be formed continuously in the sub-scanning direction, the color-mixed black dots B1 are omitted.

The first embodiment is an embodiment in which the nozzle row 15*a* of the black ink is shifted, from the nozzle rows 15*b* to 15*d* of the cyan ink, the magenta ink, and the yellow ink, in the sub-scanning direction by ½ of the predetermined spacing distance P. It is allowable, however, that the shift amount of the nozzle row 15*a* of the black ink may be arbitrary, provided that the shift amount is smaller than P. A case in which the shift amount is different from that of the first embodiment will be explained as a second embodiment by using FIG. 7 and FIGS. 8A and 8B.

Figure 7:
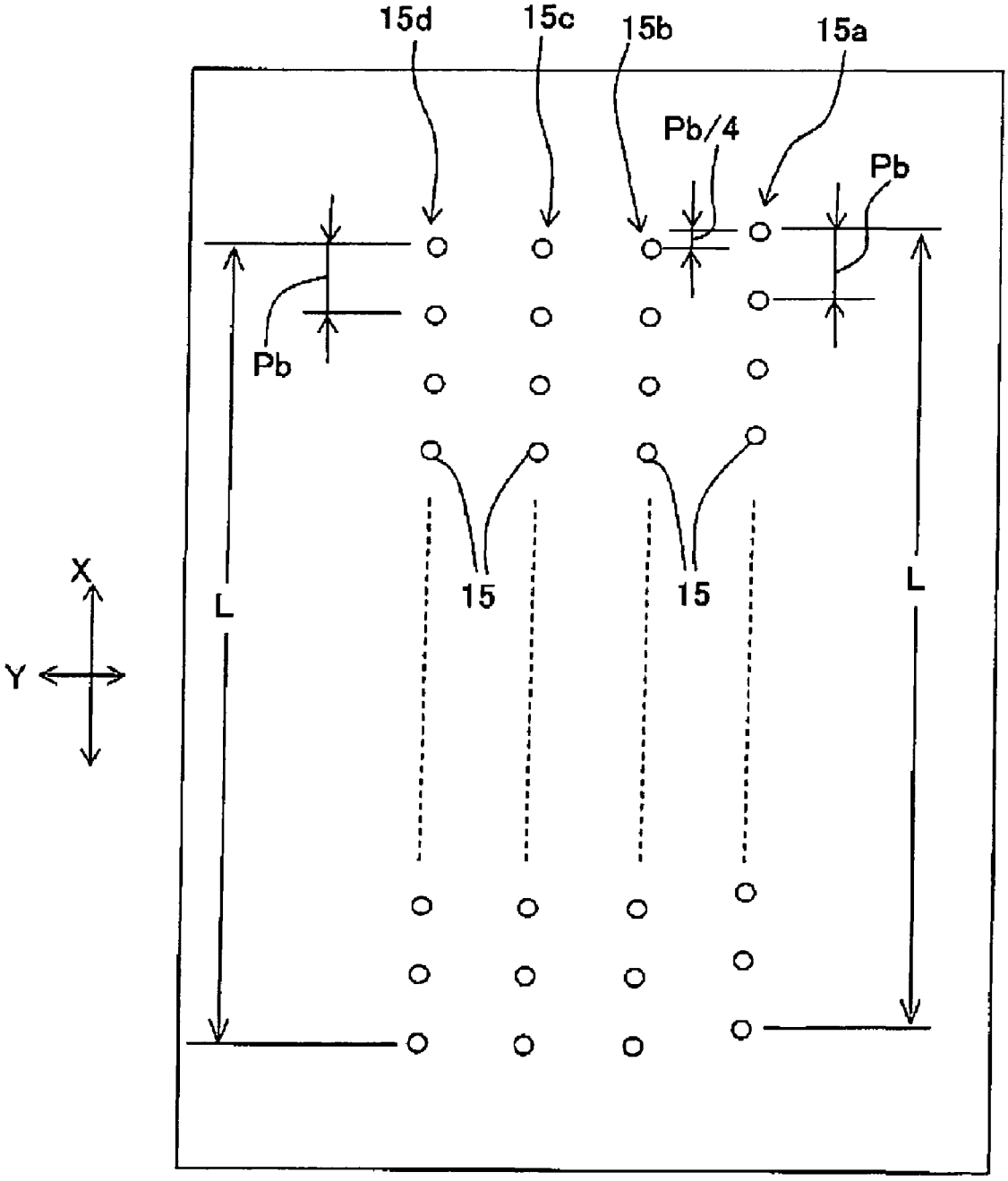
FIG. 7 is a view showing a nozzle arrangement in a second embodiment.

In the second embodiment, as shown in FIG. 7, nozzles 15 in each of a nozzle row 15*a* of the black ink (black nozzle row 15*a*), a nozzle row 15*b* of the cyan ink (cyan nozzle row 15*b*), a nozzle row 15*c* of the magenta ink (magenta nozzle row 15*c*), a nozzle row 15*d* of the yellow ink (yellow nozzle row 15*d*) are arranged in a straight line. In each of the nozzle rows, nozzles, among the nozzles 15, which are adjacent in the sub-scanning direction (X direction) are arranged at a predetermined spacing distance Pb (resolution in the sub-scanning direction is Mdpi, wherein M is a positive integer), and the black nozzle row 15*a* is shifted, with respect to the cyan nozzle row 15*b*, the magenta nozzle row 15*c*, and the yellow nozzle row 15*d* in the sub-scanning direction by an amount corresponding to ¼ of the predetermined spacing distance Pb. In each of the nozzle rows, a spacing distance between nozzles, among the nozzles 15, positioned in the nozzle row at both ends thereof is L.

Figure 8A:
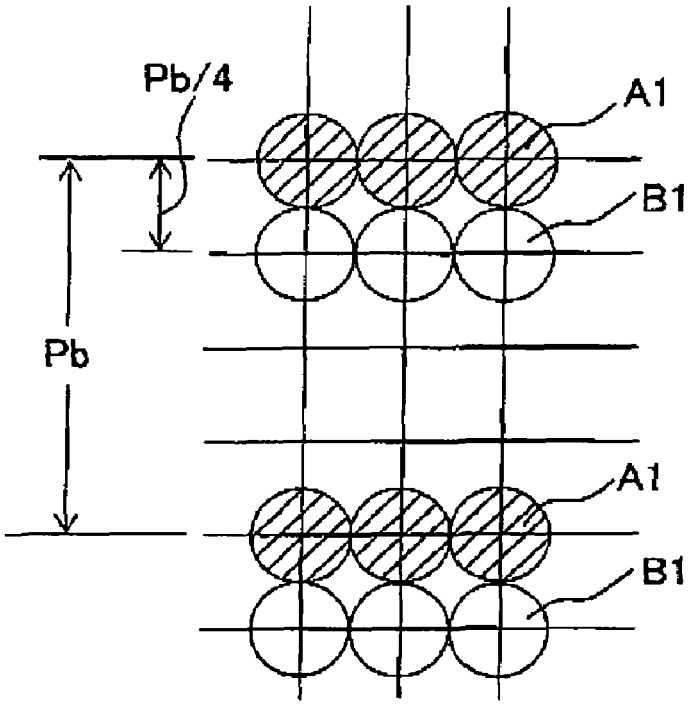
FIG. 8A and FIG. 8B are views explaining a recording state in the second embodiment in a partial manner.
Figure 8A:
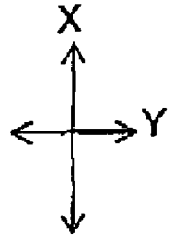
Figure 8B:
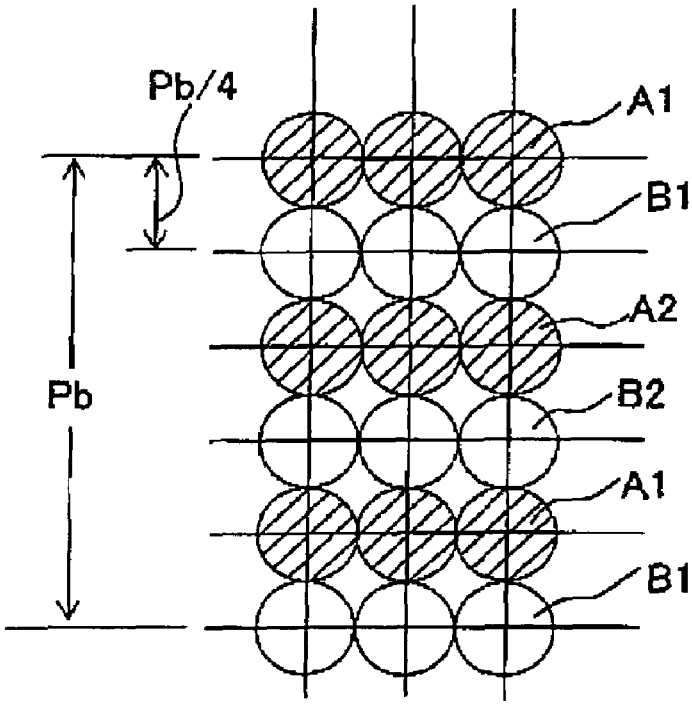

In an ink-jet printer 1 of the second embodiment, for example, in a case in which data to be recorded includes a solid black area which is continuous at least in the sub-scanning direction, or in a case in which black dots need to be formed with 4 Mdpi resolution in the sub-scanning direction, then an ink-jet head 3 is made to run once in the main scanning direction (Y direction) to form monochrome-black dots A1 and color-mixed black dots B1 adjacently in the sub-scanning direction as shown in FIG. 8A, and thereafter, a paper PA is fed in the sub-scanning direction (X direction) by a distance corresponding to Pb/2, and by making the carriage 9 run next time in the main scanning direction (Y direction), monochrome-black dots A2 and color-mixed black dots B2 are formed in a gap (space), in the sub-scanning direction, between the previously formed dots, as shown in FIG. 8B.

In the second embodiment also, similarly in the first embodiment, an opening size of the nozzles 15 of the black ink is set to be greater than an opening size of the nozzles 15 of the other color inks, and a jetting amount of each of the color inks other than the black ink to be smaller than a jetting amount of the black ink. Accordingly, it is possible to form the dots of the color-mixed black and the monochrome-black dots uniformly in size.

Note that, in the first embodiment, by performing control so that the paper PA is fed in the sub-scanning direction by an amount corresponding to P/4 and that dots are further formed between the monochrome-black dots A2 and the color-mixed black dots B2, it is possible to form a black area with dots each having a still smaller volume (that is, with high resolution).

Figure 10:
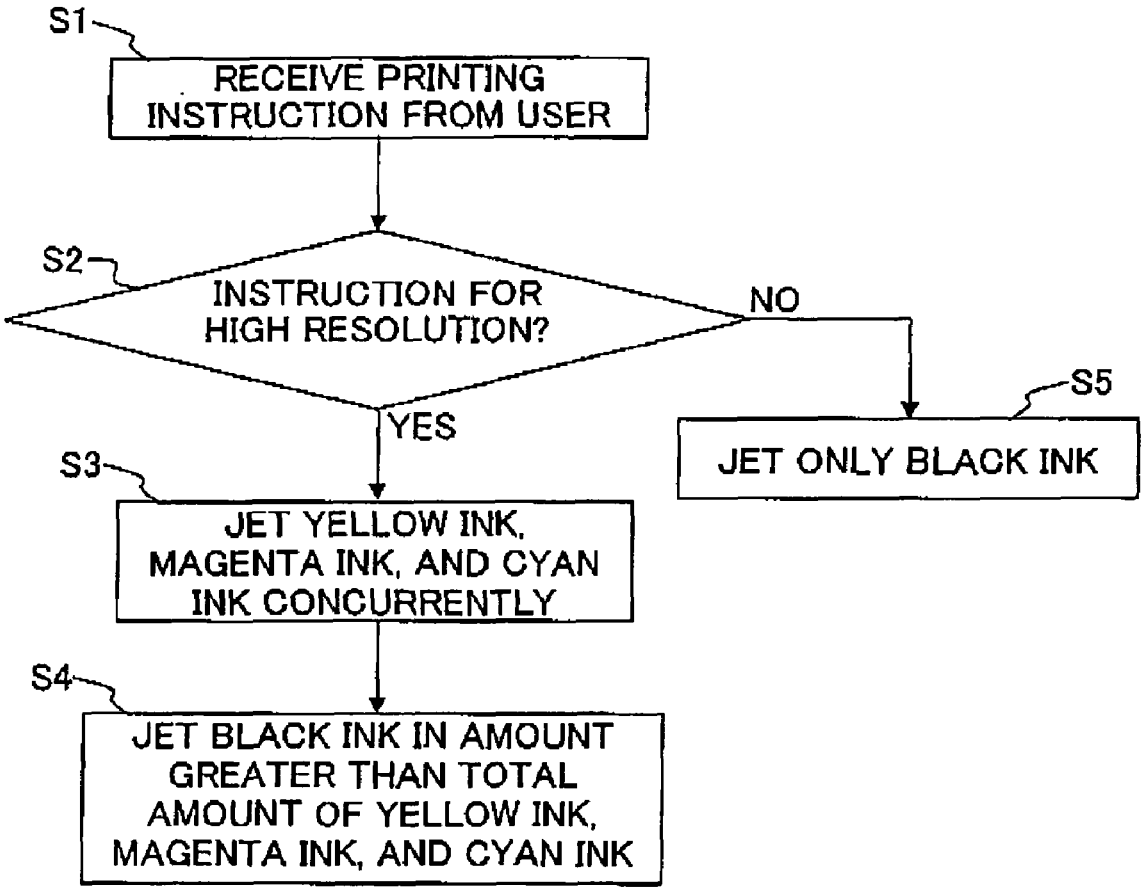
FIG. 10 is a flowchart showing a flow of an ink jetting process.

Finally, the flow of an ink jetting process in the above-described embodiments will be briefly explained by using a flowchart in FIG. 10. When a user gives a printing instruction to an ink-jet printer provided with the ink-jet head described in the above-described embodiments (S1), a judgment is made whether or not the instruction from the user is an instruction for high-resolution recording (S2). If the high-resolution recording is instructed (S2: Yes), a color-mixed black dot is formed between monochrome-black dots adjacent in the sub-scanning direction, by concurrently jetting the yellow ink, the magenta ink, and the cyan ink (S3). At this time, a jetting amount of the black ink to form one monochrome-black dot is set to be greater than the total volume of the yellow ink, the magenta ink, and the cyan ink jetted to form one color-mixed black dot (S4). In a case in which the high-resolution recording is not instructed (S2: No), the recording is performed by jetting only the black ink (S5).

The ink-jet printer and the ink jetting method of the present invention have been specifically explained. The present invention is, however, not limited to these embodiments and any modification and change may be made within the scope of the claims. For example, the ink-jet head is not limited to a piezoelectric type, and resistance wires, which generate Joule heat in response to a driving signal, may be provided in ink channels respectively. In this case, the inks in the ink channels are heated to be vaporized, thereby generating air bubbles, and the inks can be jetted by the pressure of the air bubbles.

What is claimed is:

1. An ink-jet printer which performs recording on a recording medium by jetting a black ink, a yellow ink, a magenta ink, and a cyan ink, the ink-jet printer comprising:

an ink-jet head including black, cyan, magenta and yellow nozzle rows each of which is formed of a plurality of nozzles arranged in a predetermined direction, and which are aligned in a direction orthogonal to the predetermined direction; and a controller which controls the ink-jet head;

wherein adjacent nozzles, among the nozzles in each of the nozzle rows, are arranged at a predetermined spacing distance P;

the black nozzle row is shifted, in the predetermined direction by a spacing distance ΔP smaller than the predetermined spacing distance P, from the cyan, magenta and yellow nozzle rows, respectively;

when a black dot is formed between monochrome-black dots of monochrome black which are adjacent to each other in the predetermined direction and which are formed by jetting the black ink, the controller controls the ink-jet head so that the yellow ink, the magenta ink, and the cyan ink are jetted from nozzles to form a color-mixed black dot of color-mixed black which is a mixture of the yellow ink, the magenta ink, and the cyan ink; and the controller controls the ink-jet head so that an amount of the black ink which is jetted to form one dot of the monochrome-black dots is greater than a total amount of the yellow ink, the magenta ink, and the cyan ink jetted to form the color-mixed black dot.

2. The ink-jet printer according to claim 1, wherein the black nozzle row is shifted, in the predetermined direction by ½ of the predetermined spacing distance P, from the cyan, magenta and yellow nozzle rows, respectively.

3. The ink-jet printer according to claim 1, wherein the nozzles which form the black nozzle row and which jet the black ink have an opening which is greater in size than that of the nozzles which form the cyan, magenta and yellow nozzle rows and which jet the cyan, magenta and yellow inks, respectively.

4. The ink-jet printer according to claim 3, wherein, when the color-mixed black dot is formed between the monochrome-black dots, an amount of the yellow ink, an amount of the magenta ink, and an amount of the cyan ink jetted to form the color-mixed black dot are each adjusted to be smaller than the amount of the black ink jetted to form one dot of the monochrome-black dots.

5. The ink-jet printer according to claim 3, wherein an ink each of the yellow ink, the magenta ink, and the cyan ink blurs more easily with respect to the recording medium than the black ink.

6. The ink-jet printer according to claim 5, wherein the black ink is a pigment ink; and wherein the yellow ink, the magenta ink, and the cyan ink are dye inks.

7. The ink-jet printer according to claim 1, wherein the amount of the black ink jetted to form one dot of the monochrome-black dots is 1.3 to 1.5 times an amount of each of the yellow, magenta, and cyan inks jetted to form one dot of each of the yellow, magenta, and cyan inks in a size same as that of one dot of the monochrome-black dots.

8. The ink-jet printer according to claim 1, wherein when the color-mixed black dot is formed between the monochrome-black dots, the amount of the black ink jetted to form one dot of the monochrome-black dots is smaller than a maximum ink amount jettable for forming one dot of the monochrome-black dots from each of the nozzles which form the black nozzle row and which jet the black ink.

9. An ink jetting method for jetting a black ink, a yellow ink, a magenta ink, and a cyan ink from, the method comprising:

preparing an ink-jet head which includes black, cyan, magenta and yellow nozzle rows each formed of a plurality of nozzles arranged in a predetermined direction at a predetermined spacing distance P, and are aligned in a direction orthogonal to the predetermined direction, and in which the black nozzle row is shifted, in the predetermined direction by a spacing distance $\Delta P$ smaller than the predetermined spacing distance P, from the cyan, magenta and yellow nozzle rows, respectively;

jetting the yellow ink, the magenta ink, the cyan ink concurrently so as to form a color-mixed black dot of color-mixed black which is a mixture of the yellow ink, the magenta ink, and the cyan ink, when a black dot is formed between monochrome-black dots of monochrome black which are adjacent to each other in the predetermined direction and which are formed by jetting the black ink; and adjusting an amount of the black ink to be greater than a total amount of the yellow ink, the magenta ink, and the cyan ink jetted for forming the color-mixed black dot, when one dot of the monochrome-black dots is formed.

10. The ink jetting method according to claim 9, wherein the black nozzle row is shifted, in the predetermined direction by ½ of the predetermined spacing distance P, from the cyan, magenta and yellow nozzle rows respectively.

11. The ink jetting method according to claim 9, wherein the nozzles which form the black nozzle row and which jet the black ink have an opening which is greater in size than the nozzles which form the cyan, magenta and yellow nozzle rows and which jet the cyan, magenta and yellow inks, respectively.

12. The ink jetting method according to claim 9, wherein an ink each of the yellow ink, the magenta ink, and the cyan ink blurs more easily with respect to the recording medium than the black ink.

13. The ink-jet printer according to claim 12, wherein the black ink is a pigment ink; and wherein the yellow ink, the magenta ink, and the cyan ink are dye inks.

* * * * *